US008469669B2

(12) United States Patent
Ressing

(10) Patent No.: US 8,469,669 B2
(45) Date of Patent: Jun. 25, 2013

(54) COVER DISK FOR A CLOSED IMPELLER

(75) Inventor: Henning Ressing, Bottrop (DE)

(73) Assignee: MAN Diesel & Turbo SE, Augsburg (DE)

( * ) Notice: Subject to any disclaimer, the term of this patent is extended or adjusted under 35 U.S.C. 154(b) by 489 days.

(21) Appl. No.: 12/919,553

(22) PCT Filed: Mar. 10, 2009

(86) PCT No.: PCT/EP2009/001722
§ 371 (c)(1),
(2), (4) Date: Aug. 26, 2010

(87) PCT Pub. No.: WO2009/112242
PCT Pub. Date: Sep. 17, 2009

(65) Prior Publication Data

US 2011/0008160 A1 Jan. 13, 2011

(30) Foreign Application Priority Data

Mar. 10, 2008 (DE) ..... 10 2008 013 432

(51) Int. Cl.
*F01D 5/22* (2006.01)

(52) U.S. Cl.
USPC ..... 416/186 R; 416/189

(58) Field of Classification Search
USPC ..... 416/186 R, 189, 179; 415/228
See application file for complete search history.

(56) References Cited

U.S. PATENT DOCUMENTS

| | | | | |
|---|---|---|---|---|
| 2,305,136 | A | 12/1942 | Campbell | |
| 2,392,858 | A * | 1/1946 | McMahan | 416/186 R |
| 3,887,295 | A * | 6/1975 | Yu | 415/116 |
| 2006/0280610 | A1 | 12/2006 | Heyward et al. | |

* cited by examiner

*Primary Examiner* — Edward Look
*Assistant Examiner* — William Grigos
(74) *Attorney, Agent, or Firm* — Cozen O'Connor

(57) ABSTRACT

A cover disk (1) for a closed rotor of a radial flow machine or diagonal flow machine for defining a flow channel has a wall thickness which has a local maximum along the profile mean line of the meridional cross section of the cover disk between a first front side (2) and a second front side (3) of the cover disk. An outer surface (1.2) of the cover disk remote of the flow channel has in the area of this local maximum a convex curvature with a radius (R2.2) whose ratio (R2.2/D2) to an outer diameter (D2) of the rotor is within a range of 0.05 to 0.5 (0.05≦R2.2/D2≦0.5).

11 Claims, 1 Drawing Sheet

COVER DISK FOR A CLOSED IMPELLER

PRIORITY CLAIM

This is a U.S. national stage of application No. PCT/EP2009/001722, filed on Mar. 10, 2009. Priority is claimed on the following application: Country: Germany, Application No.: 10 2008 013 432.5, Filed: Mar. 10, 2008, the content of which is incorporated here by reference.

FIELD OF THE INVENTION

The invention is directed to a cover disk for a closed rotor of a radial flow machine or diagonal flow machine, for example, a radial compressor or radial expander, particularly of a turbocompressor, a rotor with a cover disk of this kind, and a flow machine with a rotor of this kind.

BACKGROUND OF THE INVENTION

Closed rotors in which a flow channel is defined by the rotor blades, a rotor disk carrying these rotor blades, and a cover disk connected to the rotor blades are known, for example, from DE 198 33 033 A1 (U.S. Pat. No. 6,255,752 B1) which shows, in FIGS. 8 to 13, cover disks with different meridional cross sections. As can be seen in particular, the wall thickness decreases along the profile mean line of the meridional cross section of cover disks of this kind, generally continuously from a suction port to a flow outlet.

DE 37 09 518 C2 and DE 41 13831 A1 disclose closed rotors with a cover disk in which an outer surface of the cover disk remote of the flow channel has a radial offset adjoined by a conical portion of constant wall thickness so that there is a local maximum in the wall thickness of the cover disk between the suction port and the flow outlet in the radial offset. However, this is not discussed in DE 37 09 518 C2 or in DE 41 13831 A1.

In known cover disks, high stresses disadvantageously occur at unfavorable structural points.

Therefore, it is the object of the present invention to provide an improved cover disk.

SUMMARY OF THE INVENTION

The present invention is directed to a cover disk for a closed rotor of a radial flow machine or diagonal flow machine which defines a flow channel and whose wall thickness has a local maximum along the profile mean line of the meridional cross section of the cover disk between a first front side and a second front side of the cover disk, and wherein an outer surface of the cover disk remote of the flow channel has in the area of this local maximum a convex curvature with a radius (R2.2) whose ratio (R2.2/D2) to an outer diameter (D2) of the rotor is within a range from 0.05 to 0.5 ($0.05<R2.2/D2<0.5$) The present invention is based on the insight that a local convexity or bulge in the outer surface of the cover disk leads to a rotor geometry which can reduce stresses at critical structural areas in connection with a corresponding curvature of the outer surface of the cover disk during centrifugal forces occurring in operation.

To this end, it is suggested according to the invention that a convex curvature with a radius whose ratio to an outer diameter of the rotor is within a range of 0.05 to 0.5 is provided in the area of a local maximum of the wall thickness of the cover disk at the outer surface thereof. In an exemplary rotor with a cover disk of this kind, the maximum stresses are reduced by 20% and, further, advantageously no longer occur at the critical end region of the cover disk, but rather in a middle connection portion between the rotor disk and rotor blade.

A cover disk according to the invention is provided for a closed rotor of a radial flow machine or diagonal flow machine, for example, a radial compressor or radial expander, particularly of a turbocompressor, and can be produced, e.g., primary-shaped or machined, integral with the blading. Likewise, a cover disk according to the invention can also be connected, e.g., riveted, soldered and/or welded, to the blading. Also, the two constructions can be advantageously combined as is known from DE 41 13 831 A1 with radially divided rotor blades, wherein a rotor part is formed integral with the cover disk and another rotor part is nondetachably connected thereto.

The cover disk, together with a two-dimensional or three-dimensional blading and the rotor disk, defines a flow channel for a fluid to be conveyed, compressed or expanded. In a meridional plane, the cover disk has a profile mean line or skeleton line which extends in the middle between the outer surface of the cover disk remote of the flow channel and an inner surface of the cover disk facing the flow channel.

The cover disk has a local maximum along this profile mean line between a first front side and a second front side. The first front side can be, for example, an inlet side or suction side, and the second front side can correspondingly be an outlet side or pressure side. In other words, the cover disk according to the invention has a bulge on its outer surface between the inlet and outlet.

In the region of this local maximum, the outer surface has a convex, outwardly curved curvature with a radius whose ratio to the outer diameter of the rotor is within a range of 0.05 to 0.5. In particular, the largest diameter or the rated diameter of the rotor is the outer diameter of the rotor.

The bulge results in a more favorable distribution of mass so that the maximum stresses occurring in operation are reduced. Accordingly, higher rotor speeds, longer lifetimes and/or the use of weaker and, therefore, cheaper materials are possible. Further, the occurrence of maximum stresses on structurally unfavorable locations such as the outer circumference of the cover disk in the region where it is connected to the rotor blading, which is often carried out as a weld, can be avoided or such stresses reduced by the convex curvature with the radius ratio according to the invention.

The ratio of the radius to the outer diameter is preferably between 0.1 and 0.4, particularly preferably between 0.15 and 0.3. This results in rotors which are particularly free from stresses.

In a preferred embodiment of the present invention, the convex curvature of the outer surface of the cover disk merges toward the first front side and/or second front side into a concave curvature so that the outer edge of the meridional cross section has an inflection point before and/or after the local maximum in which the curvature changes its mathematical sign. Outer surfaces of this kind with areas which are curved in opposite directions one or more times are particularly stress-free and can be manufactured easily.

The concave curvature can have a radius toward the first front side which is smaller than the radius of the convex curvature in the region of the local maximum. Accordingly, a cover disk according to the invention can be axially compact because the convex, gently curved area can slope relatively steeply in the axial direction in the concave area with the smaller radius.

In a preferred construction, the wall thickness of the cover disk decreases continuously toward the second front side. In contrast to the cover disks known from DE 37 09 518 C2 and DE 41 13831 A1 with conical outer portions of constant thickness, the external mass and, therefore, the mass moment of inertia, the weight, and the production costs can be reduced in the present case, and the continuous reduction, particularly a reduction with a substantially constant radius of curvature, provides for an advantageous distribution of stresses. It is particularly preferable that the cover disk terminates toward its outer circumference in a concavely curved portion which adjoins the convexly curved portion in the area of the local maximum. Of course, this includes constructions in which the outer circumferential edge of the outer surface itself is interrupted or is formed with a small convex radius in some other way.

BRIEF DESCRIPTION OF THE DRAWINGS

Additional advantages and features will become more apparent after referring to the following description and attached drawings in which.

DETAILED DESCRIPTION OF THE PRESENTLY PREFERRED EMBODIMENTS

Figure 2:
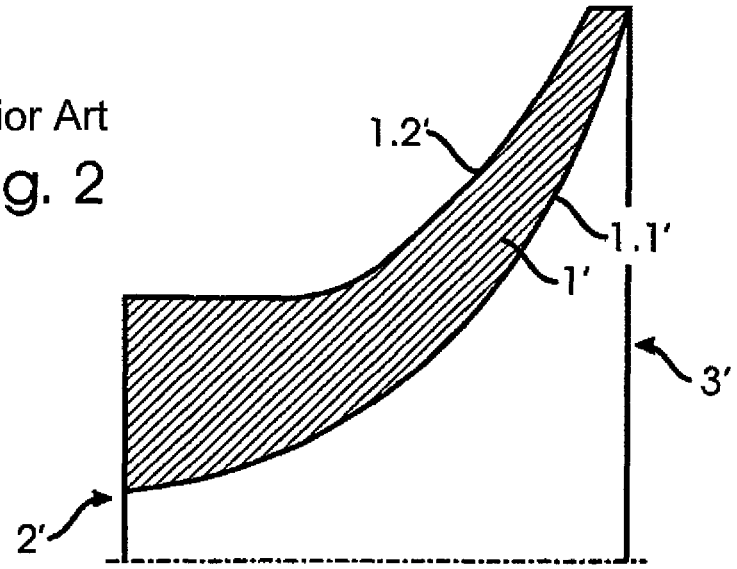
Prior Art Fig. 2
FIG. 2 is a meridional cross sectional view through half of a cover disk according to the prior art.

FIG. 2 shows a half-sectional view of the meridional cross section of a cover disk 1' of a radial rotor (not shown) according to the prior art such as is known, for example, from FIG. 12 of DE 198 33 033 A1.

The thickness of this cover disk 1' defined by inner surface 1.1' and outer surface 1.2' decreases along the profile mean line of the meridional cross section between a first front side 2' of the cover disk (at left in FIG. 2) defining a suction port of a radial flow machine (not shown) and a second front side 3' of the cover disk (at right in FIG. 2) which lies axially opposite from the first front side 2' and which forms a flow outlet from the flow channel defined by the cover disk 1' continuously from the suction port 2' to the flow outlet 3'.

Figure 1:
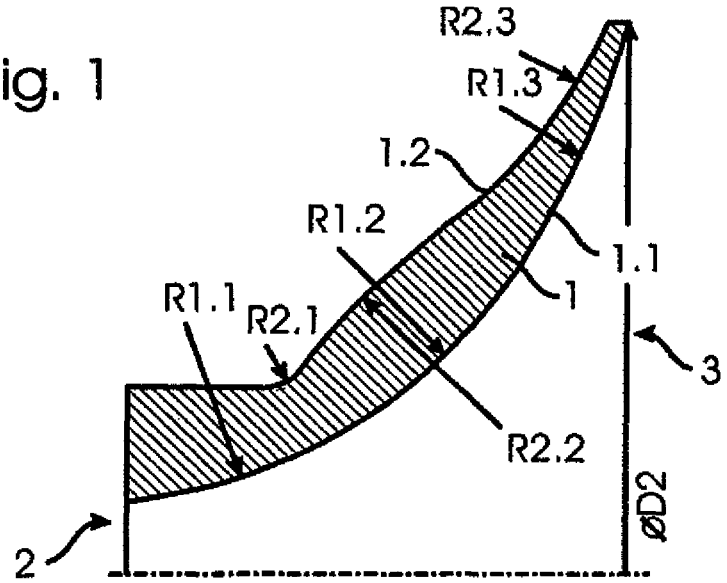
FIG. 1 is a meridional cross sectional view through half of a cover disk according to an embodiment of the present invention.

In a view corresponding to FIG. 2, FIG. 1 shows the meridional cross section of a cover disk 1 of a radial rotor (not shown) according to an embodiment of the present invention with a first front side 2 (at left in FIG. 1) through which a radial flow machine (not shown) takes in fluid axially and, axially opposite to this first front side 2, a second front side 3 of the cover disk (at right in FIG. 1) from which the fluid exits radially from the flow channel which is defined by the cover disk 1 and rotor blades (not shown) and a rotor disk (not shown) carrying these rotor blades.

An inner surface 1.1 facing the flow channel has three convexly curved areas with radii of curvature R1.1, R1.2 and R1.3. The radius is indicated, respectively, by an arrow directed from a center of curvature to the surface in FIG. 1.

Proceeding from the first front side 2, an outer surface 1.2 of the cover disk 1 opposite the inner surface 1.1 has an non-curved area parallel to a longitudinal axis of the rotor (dash-dot lines in FIG. 1). This area merges into a concave area with a relatively small radius of curvature R2.1, the wall thickness of the cover disk 1 narrowing to a local minimum in its perpendicular bisector.

Adjoining this concave area is a portion which curves away from the flow channel and which has a convex curvature with a radius R2.2 which is greater than the radius of curvature R2.1. Because of the change from a concave to a convex curvature, the centers of curvature lie on opposite sides of the outer surface 1.2 as is indicated by the different arrow directions in FIG. 1.

The convex area in turn merges again in direction toward the second front side 3 into a concave area having a radius of curvature R2.3 in which the wall thickness of the cover disk 1 decreases continuously toward the second front side.

Because of the alternating concave-to-convex-to-concave curvature of the outer surface 1.2 of the cover disk 1 and the continuous convex curvature of the oppositely located inner surface 1.1, the wall thickness along the profile mean line of the meridional cross section of the cover disk 1 has a local maximum between the first front side 2 and the second front side 3. In the area of this local maximum, the outer surface 1.2 has a convex curvature with radius R2.2 whose quotient to an outer diameter D2 of the rotor is:

$$R2.2/D2 \approx 0.22.$$

Accordingly, due to the centrifugal forces acting on the cover disk, the maximum stresses occur at the transition (not shown) from the rotor blade to the rotor disk and no longer in the area of the second front side 3 of the cover disk 1. Further, the absolute value of the maximum stress at a defined speed load decreases by 20%.

The invention is not limited by the embodiments described above which are presented as examples only but can be modified in various ways within the scope of protection defined by the appended patent claims.

The invention claimed is:

1. A cover disk for a closed rotor of a flow machine, comprising:

an outer surface (1.1), a wall thickness and an inner surface (1.2) defining a flow channel, a meridional cross section having a profile mean line; said wall thickness having a local maximum along said profile mean line of said meridional cross section of said cover disk between a first front side (2) and a second front side (3); said outer surface (1.2) of said cover disk remote of the flow channel having in an area of said local maximum a convex curvature having a radius (R2.2.), the ratio (R2.2/D2) of said radius of said convex curvature to an outer diameter (D2) of said rotor being within the range of from 0.05 to 0.5 ($0.05 \leqq R2.2/D2 \leqq 0.5$).

2. The cover disk according to claim 1, wherein said ratio (R2.2/D2) of said radius (R2.2) to said outer diameter (D2) is between 0.1 and 0.4 ($0.1 \leqq R2.2/D2 \leqq 0.4$).

3. The cover disk according to claim 2, wherein said ratio (R2.2/D2) of said radius (R2.2) to said outer diameter (D2) is between 0.15 and 0.3 ($0.15 \leqq R2.2/D2 \leqq 0.3$).

4. The cover disk according to claim 1, wherein said convex curvature of said outer surface of said cover disk merges toward one of said first front side and second front side into a concave curvature.

5. The cover disk according to claim 4, wherein said concave curvature has a radius (R2.1) toward said first front side which is smaller than said radius (R2.2) of said convex curvature in said area of said local maximum.

6. The cover disk according to claim 1, wherein said wall thickness of said cover disk decreases continuously toward said second front side.

7. The cover disk according to claim 1, wherein said first front side is a suction side, and said second front side is an outlet side.

8. A closed rotor for a flow machine with a cover disk according to claim 1, wherein said cover disk is one of formed integral with and is connected to a blading.

9. A flow machine, comprising a closed rotor according to claim 8.

10. The cover disc according to claim 1, wherein the flow machine is one of a radial flow machine and a diagonal flow machine.

11. The cover disc according to claim 1, wherein the flow machine is a turbocompressor.

* * * * *